US010165908B1

(12) United States Patent
Liu et al.

(10) Patent No.: US 10,165,908 B1
(45) Date of Patent: Jan. 1, 2019

(54) HAND DRYER WITH REDUCED AIR-INTAKE NOISE

(71) Applicant: HOKWANG INDUSTRIES CO., LTD., New Taipei (TW)

(72) Inventors: Shen-Chen Liu, New Taipei (TW); Cing-Fong Jheng, New Taipei (TW)

(73) Assignee: HOKWANG INDUSTRIES CO., LTD., New Taipei (TW)

( * ) Notice: Subject to any disclaimer, the term of this patent is extended or adjusted under 35 U.S.C. 154(b) by 0 days.

(21) Appl. No.: 15/696,725

(22) Filed: Sep. 6, 2017

(51) Int. Cl.
*A47K 10/48* (2006.01)
*F26B 21/00* (2006.01)

(52) U.S. Cl.
CPC ..... *A47K 10/48* (2013.01); *F26B 21/001* (2013.01)

(58) Field of Classification Search
CPC ..... A47K 10/48; F26B 21/001
USPC ..... 34/218
See application file for complete search history.

(56) References Cited

U.S. PATENT DOCUMENTS 1,961,179 A * 6/1934 Tinkham ..... A47K 10/48 34/202
5,377,427 A * 1/1995 Mashata ..... A47K 10/485 34/275
5,459,944 A * 10/1995 Tatsutani ..... A47K 10/48 34/202
6,038,786 A * 3/2000 Aisenberg ..... A47K 10/48 34/202
7,946,055 B2 * 5/2011 Churchill ..... A47K 10/48 134/26
8,064,756 B2 * 11/2011 Liu ..... A47K 10/48 392/360
8,341,853 B2 * 1/2013 French ..... A47K 10/48 15/300.1
8,347,521 B2 * 1/2013 Churchill ..... A47K 10/48 134/26
8,347,522 B2 * 1/2013 Dyson ..... A47K 10/48 34/104
8,490,291 B2 * 7/2013 Churchill ..... A47K 10/48 222/1

(Continued)

FOREIGN PATENT DOCUMENTS

CN 201194769 Y 2/2009
CN 105919494 A 9/2016

(Continued)

*Primary Examiner* — Stephen M Gravini
(74) *Attorney, Agent, or Firm* — Muncy, Geissler, Olds & Lowe, P.C.

(57) ABSTRACT

A hand dryer with reduced air-intake noise includes a housing, a flow-guide plate, and an air supply module. The housing includes an accommodating space and a plurality of narrow air inlets. The flow-guide plate is disposed inside the accommodating space, but the flow-guide plate is not contacted with the housing. The flow-guide plate includes a plurality of narrow air guide holes. The air supply module is disposed inside the accommodating space, and includes a blower that extracts air inside the accommodating space to generate a drying air flow after being started and an air-guide piece connected to the blower to receive the drying air flow. An interval between the narrow air inlet and the narrow air guide hole interferes with transmission of a sound wave formed by the air flowing between the narrow air inlet and the narrow air guide hole, so that generated noise can be greatly reduced.

5 Claims, 6 Drawing Sheets

(56) References Cited

U.S. PATENT DOCUMENTS

| | | | | |
|---|---|---|---|---|
| 8,544,186 | B2 * | 10/2013 | Hsu | A47K 10/48 34/202 |
| 8,607,472 | B2 * | 12/2013 | Ishii | A47K 10/48 15/97.1 |
| 9,220,381 | B2 * | 12/2015 | Akiyoshi | A47K 10/48 |
| 9,538,886 | B2 * | 1/2017 | Ros Marin | A47K 10/48 |
| 9,826,865 | B2 * | 11/2017 | Maruyama | G01F 23/268 |
| 9,839,334 | B2 * | 12/2017 | Casla Arruiz | A47K 10/48 |
| 2006/0000110 | A1 * | 1/2006 | Aisenberg | A47K 10/48 34/443 |
| 2013/0111778 | A1 | 5/2013 | Bao | |

FOREIGN PATENT DOCUMENTS

| | | | | |
|---|---|---|---|---|
| DE | 202012006801 | U1 * | 8/2012 | A47K 10/48 |
| EP | 0481925 | A1 * | 4/1992 | A47K 10/48 |
| GB | 2249026 | A * | 4/1992 | A47K 10/48 |
| JP | 5511963 | B2 * | 6/2014 | A47K 10/48 |
| WO | WO 2014125146 | A1 * | 8/2014 | A47K 10/48 |

* cited by examiner

HAND DRYER WITH REDUCED AIR-INTAKE NOISE

FIELD OF THE INVENTION

The present invention is related to a hand dryer with reduced air-intake noise, particularly to a hand dryer with a flow-guide plate mounted inside a housing and corresponding to an air inlet.

BACKGROUND OF THE INVENTION

With the civilization of society, there is growing concern over sanitation in daily life. A notable example is public baths for nondiscriminatory use by ordinary people. To rapidly remove residual water on the hands of a user after the user washes the hands, hand-wiping paper (towels) is usually provided at public baths. As people have increasing awareness of environmental protection and pay careful attention to forestry resources, it becomes increasingly evident that disposable paper (towels) is not practical. Therefore, hand dryers become popular and are widely disposed at public places to meet people's requirements of rapid hand drying.

In view of this, after the high economic development in the last century, people are concentrated in urban areas and many huge cities appear. People usually strive for speed and efficiency. At present, accordingly, a main objective of commercially available hand dryers is to improve the efficiency of hand drying. A major difficulty in the industrial design of the hand dryers is to work out a compromise between efficiency and noise. It should be known that in the process of continuously accelerating the operation of a motor to supply air, during extraction of air, friction occurs between related mechanisms of the hand dryer inevitably to generate wind noise. If the rotational speed of the motor is deliberately reduced to reduce the wind noise in the operation of the hand dryer, a working time of the hand dryer needs to be increased to dry hands thoroughly.

A common point between the technologies disclosed in US Patent No. 20130111778 and China Patent No. 201194769 lies in that: The hand dryer includes a motor and an air path structure. The air path structure includes an air inlet and a plurality of water-retaining sheets disposed at the air inlet. A gap is formed between one of the plurality of water-retaining sheet and another adjacent water-retaining sheet. When the hand dryer is working, air enters the air path structure through the gaps. Because of a smoother air path, noise generated during working can be reduced.

In addition, a hand dryer shown in China Patent No. 105919494 includes a housing and a motor disposed inside the housing. A first air inlet is disposed on the housing. The motor includes a second air inlet and an air intake channel connected to the first air inlet and the second air inlet. The air intake channel includes a baffle disposed in the air intake channel and a gap that is defined by the baffle and the inner wall of the air intake channel. The baffle is used to reflect noise that is generated when the motor is running and propagates externally along the air intake channel. Through the gap, an air flow disperses first and then gathers, so as to produce a flow-regulation effect and reduce noise generated from the air flow.

However, when only a blower structure is improved, it is still difficult to reach the extreme objective of being "super-silent". Therefore, how to work out a compromise between efficiency and noise for the purpose of noise reduction is in fact a major topic in the industrial design in this technical field.

SUMMARY OF THE INVENTION

It is one object of the present invention to improve an air inlet structure of an existing hand dryer, so as to mitigate the problem of generated noise.

For achieving the above object, the present invention provides a hand dryer with reduced air-intake noise, including a housing, a flow-guide plate, and an air supply module. The housing has an accommodating space and a plurality of narrow air inlets connecting the accommodating space and the outside of the housing. The housing defines an air intake surface that faces the accommodating space and on which the plurality of narrow air inlets are provided. The flow-guide plate is disposed inside the accommodating space and is assembled, corresponding to the air intake surface with the housing. The flow-guide plate is not in contact with the air intake surface. The flow-guide plate includes a plurality of narrow air guide holes. The air supply module is disposed inside the accommodating space. The air supply module includes a blower that extracts air inside the accommodating space to generate a drying air flow after being started and an air-guide piece that is connected to the blower to receive the drying air flow and includes an end exposed from the housing. The hand dryer includes an air intake path that enables, after the blower is started, air outside the housing to sequentially flow through the plurality of narrow air inlets and the plurality of narrow air guide holes to enter the blower.

In an embodiment, the flow-guide plate includes a plate body on which the plurality of narrow air guide holes are provided and an extension sheet that extends from the plate body and is mounted at the housing.

In an embodiment, the flow-guide plate has at least one support post that is disposed on a side facing the air intake surface and protrudes towards the housing to be connected to the housing.

In an embodiment, the plurality of narrow air inlets are arranged in a first matrix and provided on the housing, and the plurality of narrow air guide holes are arranged in a second matrix and provided on the flow-guide plate.

In an embodiment, the plurality of narrow air inlets are provided on the housing in a first extending direction, the plurality of narrow air guide holes are provided on the flow-guide plate in a second extending direction, and projection locations of the plurality of narrow air inlets on the air intake surface are not overlapped with the plurality of narrow air guide holes.

Therefore, the present invention provides, in comparison with prior art, advantageous effects as follows.

In the present invention, for the air intake surface, the flow-guide plate that faces the air intake surface but is not in contact with the air intake surface is disposed. The plurality of narrow air guide holes on the flow-guide plate and the plurality of narrow air inlets on the air intake surface form a double-slit structure. When the hand dryer draws in air, the noise of air that enters along the air intake path can be reduced by the plurality of narrow air guide holes and the plurality of narrow air inlets, thereby reducing the noise when air is being drawn in.

DETAILED DESCRIPTION OF THE PREFERRED EMBODIMENTS

Details and technical contents of the present invention are given with the accompanying drawings below.

Figure 1:
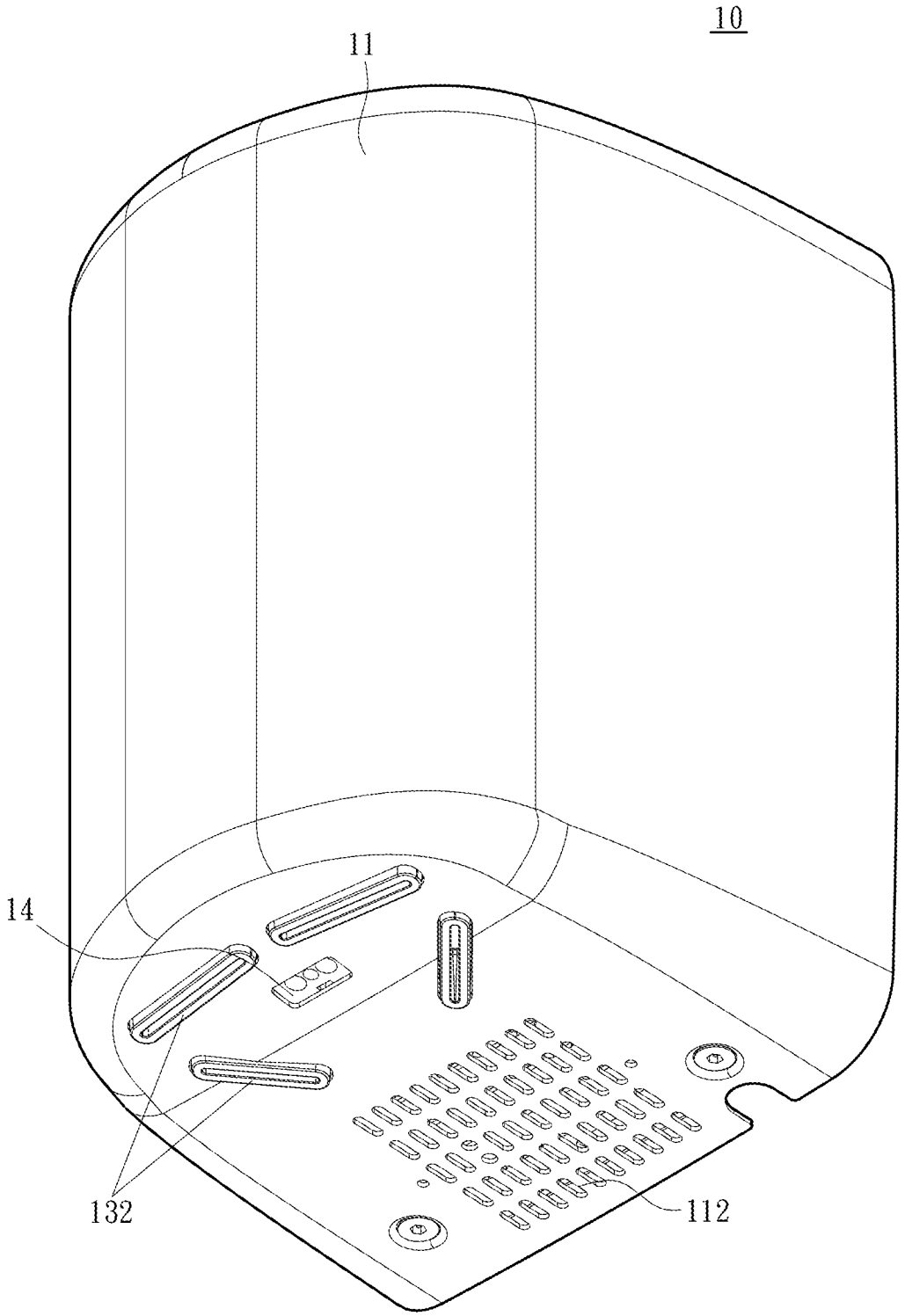
FIG. 1 schematically shows a three-dimensional outside view of the present invention.
Figure 2:
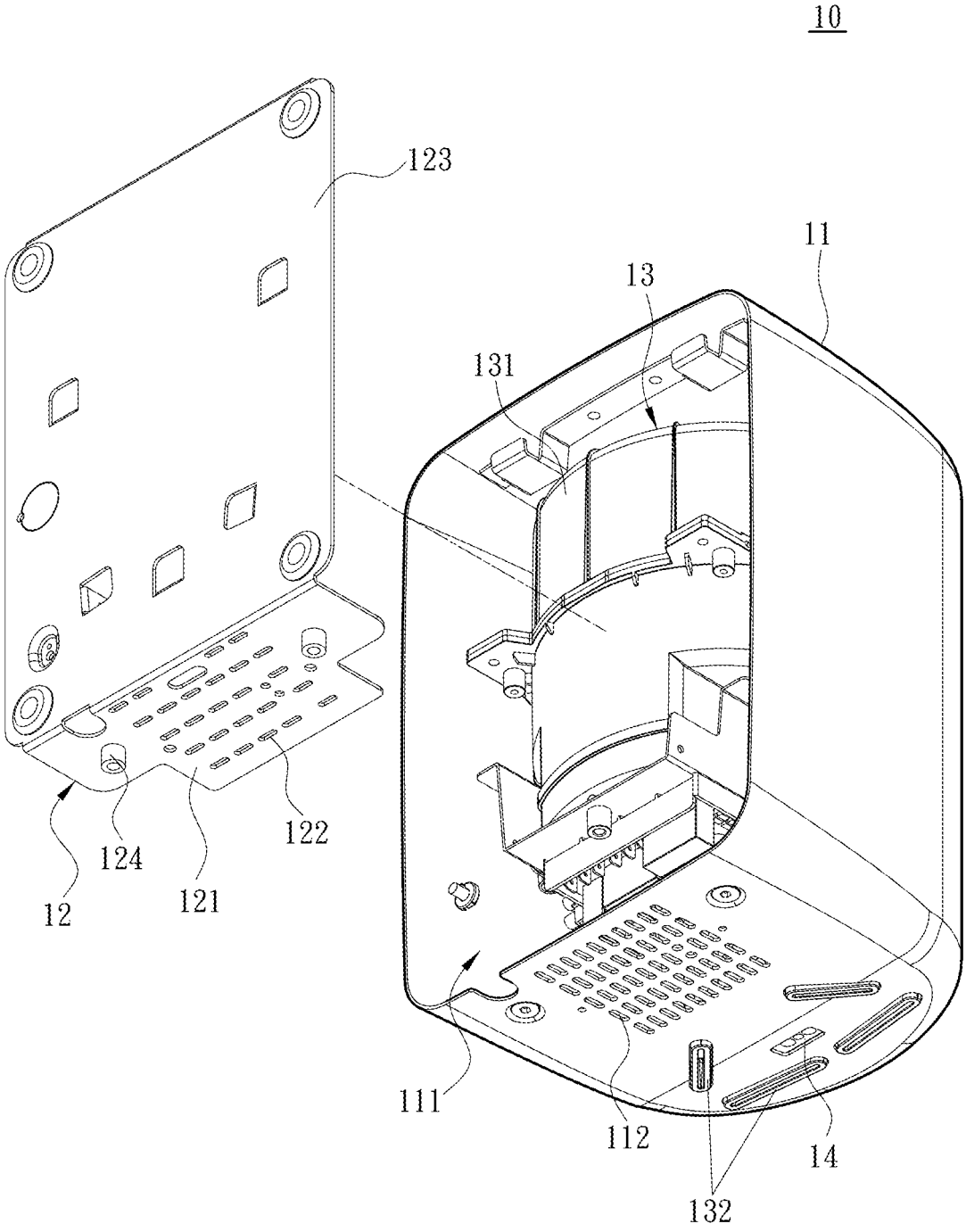
FIG. 2 is an exploded schematic diagram of the present invention.
Figure 3:
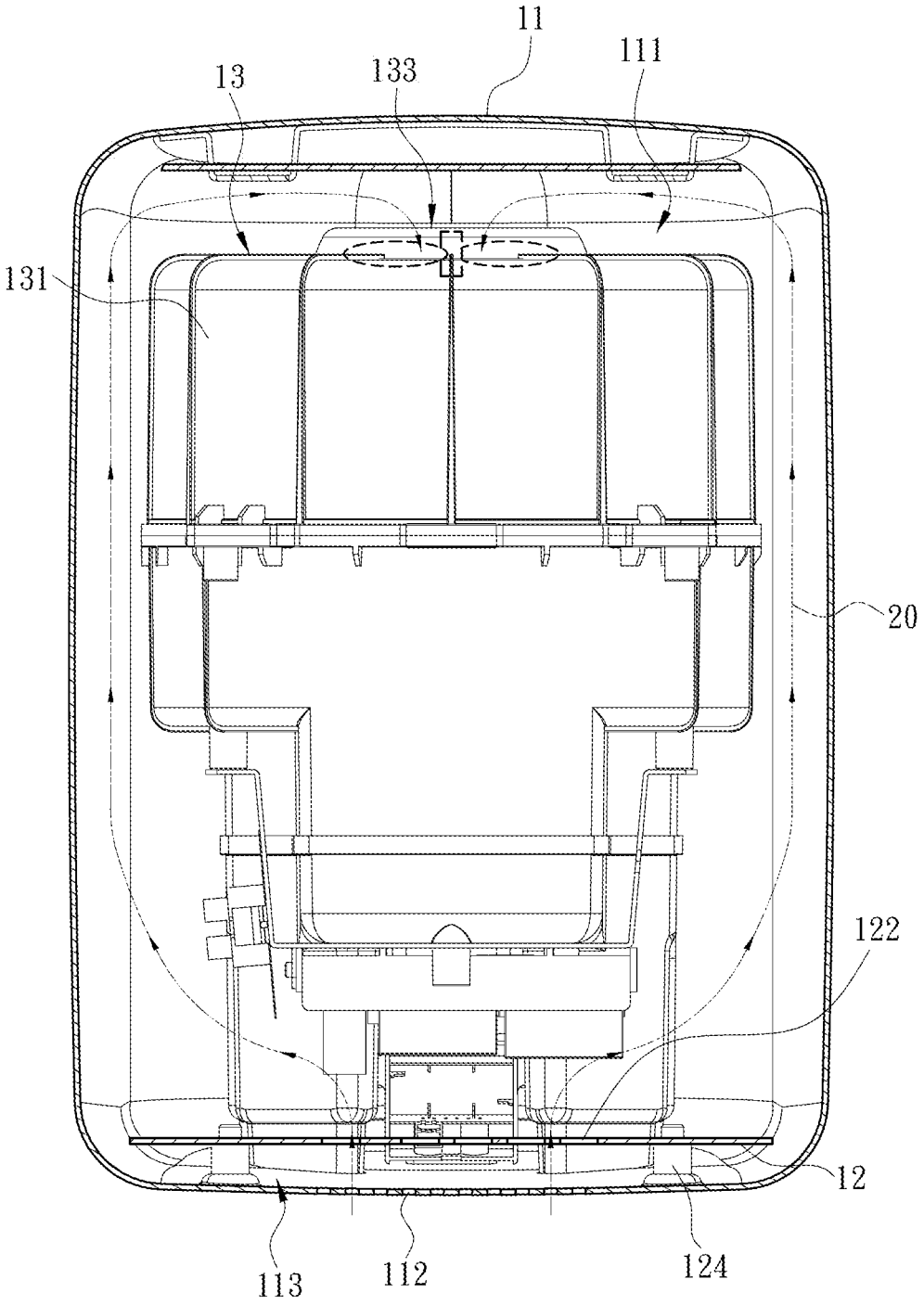
FIG. 3 schematically shows a front sectional view of the present invention.

Referring to FIG. 1, FIG. 2 and FIG. 3, the present invention provides a hand dryer 10 with reduced air-intake noise, including a housing 11, a flow-guide plate 12, an air supply module 13, and a switching sensing element 14. The flow-guide plate 12, the air supply module 13, and the switching sensing element 14 are disposed in the housing 11. Although the switching sensing element 14 is assembled in the housing 11, after being assembled, the switching sensing element 14 can still be directly observed from outside the housing 11. Furthermore, the housing 11 may be formed by assembling a plurality of half housings. The housing 11 defines an accommodating space 111. Moreover, a plurality of narrow air inlets 112 that connects the accommodating space 111 and an outer area of the housing 11 are provided on the housing 11, and the present invention defines an air intake surface 113 that faces the accommodating space 111 and on which the plurality of narrow air inlets 112 are provided. Accordingly, in the current embodiment of the present invention, although the air intake surface 113 is located at a bottom edge of the housing 11, the present invention is not limited thereto. The plurality of narrow air inlets 112 may be provided on different surfaces of the housing 11 according to implementation requirements.

Figure 4:
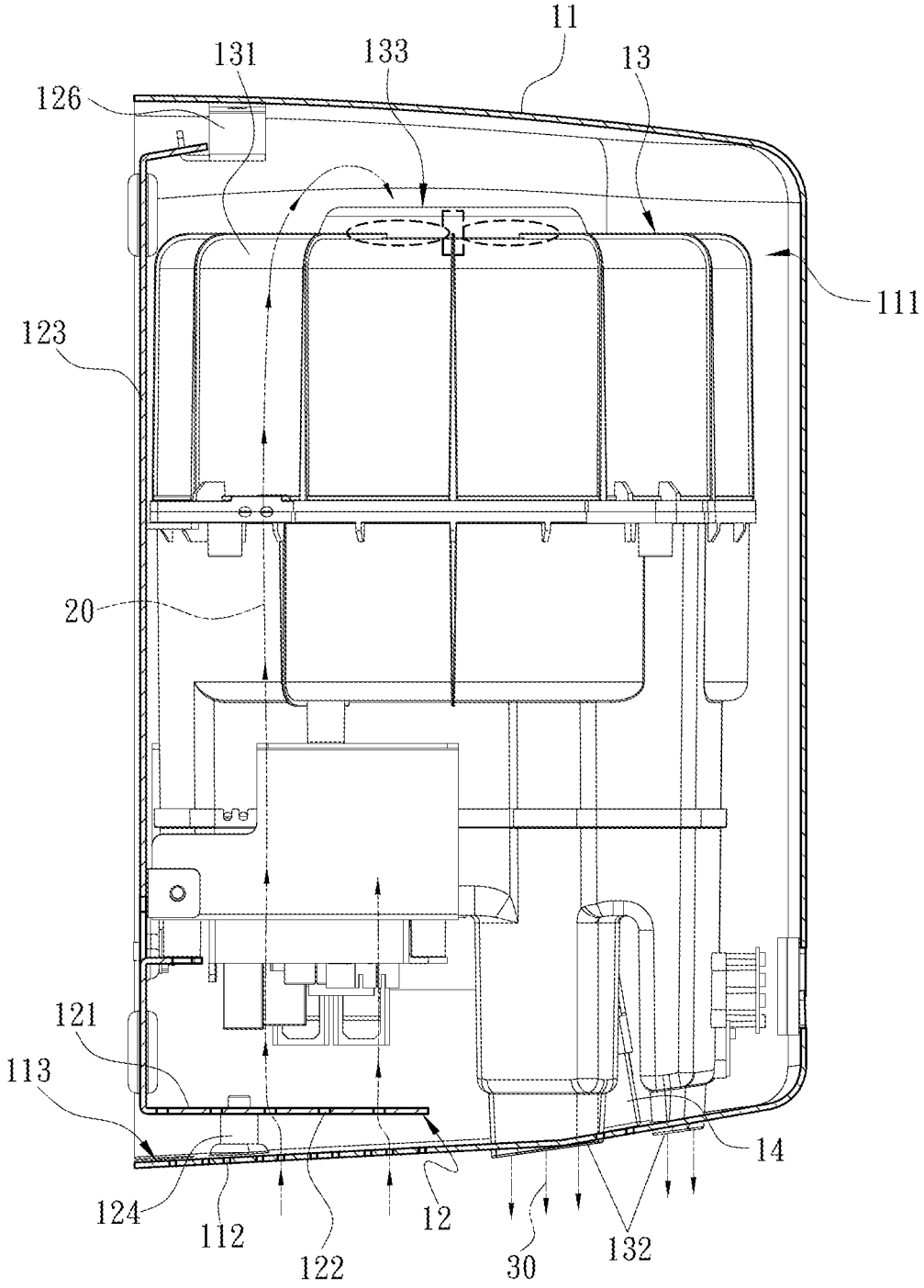
FIG. 4 schematically shows a right sectional view of the present invention.
Figure 6:
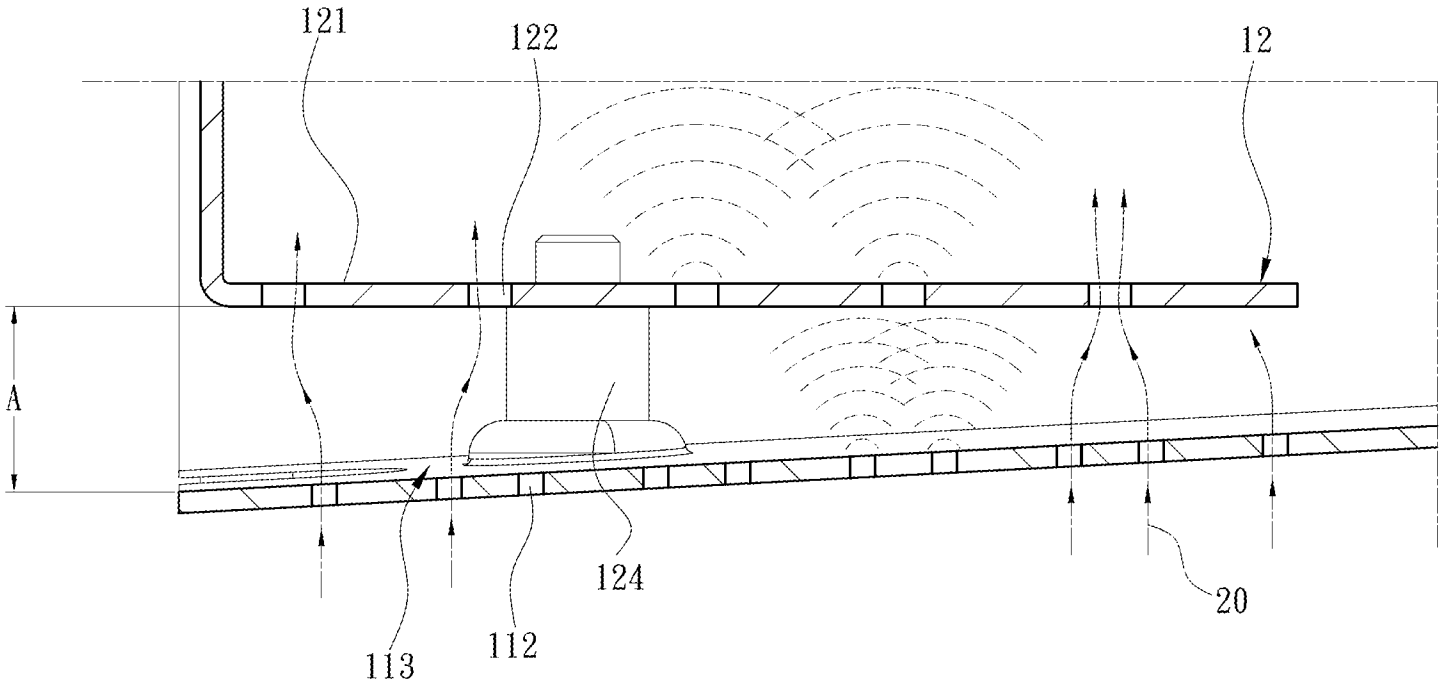
FIG. 6 schematically shows a partial right sectional view of the present invention.

Next, referring to FIG. 3, FIG. 4, and FIG. 6, the flow-guide plate 12 is disposed inside the accommodating space 111, and is assembled, facing the air intake surface 113, with the housing 11. Further, in the present invention, the flow-guide plate 12 is not in contact with the air intake surface 113, and has a plurality of narrow air guide holes 122 provided on the flow-guide plate 12. Specifically, an interval A exists between the flow-guide plate 12 and the housing 11. The size of the interval A is properly adjusted according to the size of the housing 11. The size of the interval A at least needs to be large enough to make the plurality of narrow air inlets 112 and the plurality of narrow air guide holes 122 form a double-slit structure.

Referring to FIG. 2 and FIG. 4 again, in the present invention, an arrangement relationship between the flow-guide plate 12 and the housing 11 is further described herein. In an embodiment, the housing 11 includes a U-shaped structure, so that the housing 11 has an opening side. Furthermore, the flow-guide plate 12 includes a plate body 121 on which the plurality of narrow air guide holes 122 are provided and an extension sheet 123 that extends from the plate body 121. Furthermore, the size of the extension sheet 123 may be basically the same as that of the opening side of the housing 11. The extension sheet 123 may be placed at the opening side of the housing 11, and is further mounted with the housing 11 to cover the accommodating space 111. Moreover, the flow-guide plate 12 includes at least one support post 124 that is disposed on a side facing the air intake surface 113 and protrudes towards the housing 11 to be connected to the housing 11, and a mounting portion 126 that is disposed on the other side, opposite the support post 124, of the extension sheet 123 and is overlapped on the housing 11. Accordingly, in the present invention, the support post 124 and the mounting portion 126 are used to fix the extension sheet 123 stably, thereby preventing resonance of the extension sheet 123 during the operation of the hand dryer 10 to cause noise.

Figure 5:
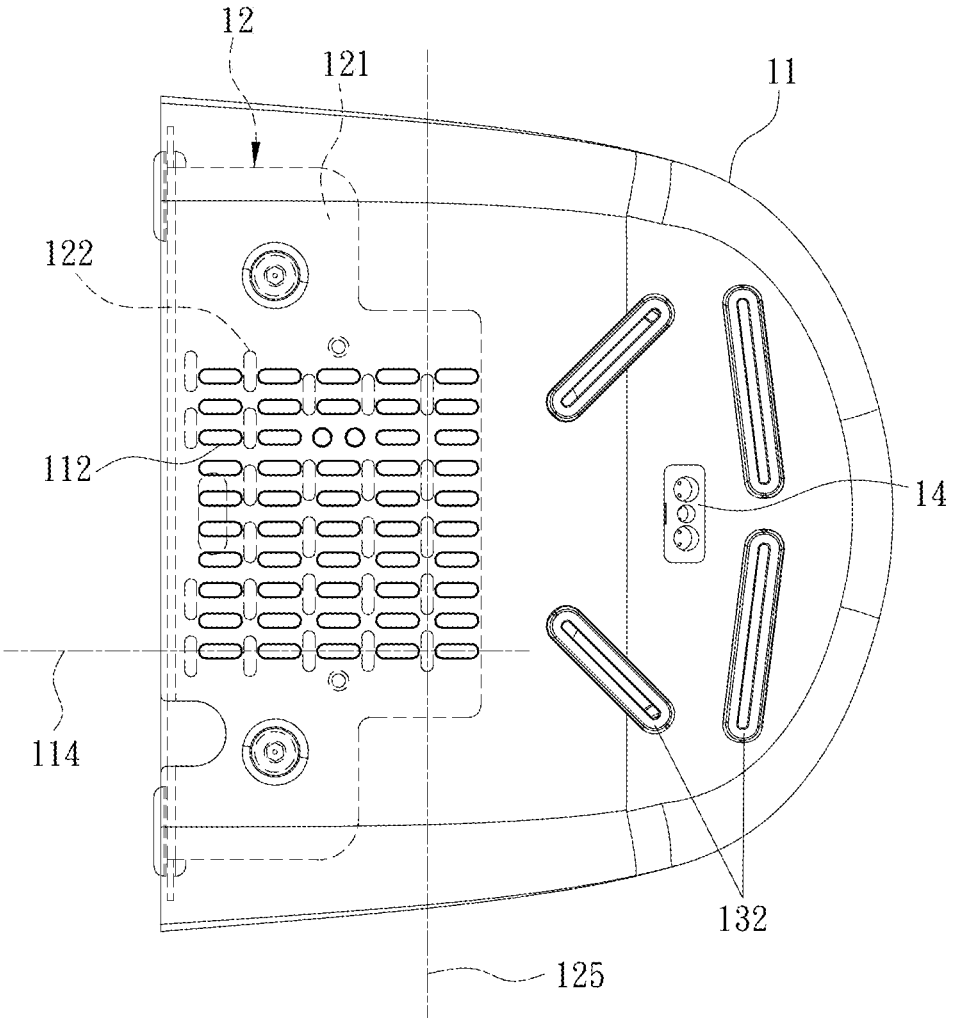
FIG. 5 schematically shows a top view of the present invention.

Referring to FIG. 5 and FIG. 6 again, in an embodiment, the plurality of narrow air inlets 112 of the present invention are arranged in a first matrix and provided on the housing 11, and the plurality of narrow air guide holes 122 of the present invention are arranged in a second matrix and provided on the flow-guide plate 12. Moreover, the first matrix and the second matrix may be the same or different.

Furthermore, each of the plurality of narrow air inlets 112 has a long narrow form and an extending direction along a long side of the plurality of narrow air inlets 112 is a first extending direction 114. Furthermore, each of the plurality of narrow air guide holes 122 also has a long narrow form and an extending direction along a long side of the plurality of narrow air guide holes 122 is a second extending direction 125. Moreover, in the present invention, projection locations of the plurality of narrow air inlets 112 are further not overlapped with the plurality of narrow air guide holes 122. That is, projection locations of the plurality of narrow air inlets 112 and the plurality of narrow air guide holes 122 form staggered arrangement. Accordingly, in the present invention, the plurality of narrow air inlets 112 and the plurality of narrow air guide holes 122 form the double-slit structure, so that each partial sound wave generated when air 20 flows through one of the plurality of narrow air inlet 112 is canceled by a sound wave generated at another adjacent narrow air inlet 112, so as to form a sound wave with relatively low noise. After passing through the one of the plurality of narrow air guide hole 122, the sound wave with relatively low noise is interfered with and is canceled again by a sound wave with relatively low noise that passes through another adjacent narrow air guide hole 122, so as to form a sound wave with the lowest noise. In this way, a noise reduction effect is achieved.

Referring to FIG. 2, FIG. 3 and FIG. 4 again, the air supply module 13 is disposed inside the accommodating space 111. The air supply module 13 includes a blower 131 used to extract the air 20, an air-guide piece 132 connected to the blower 131, and a blower inlet opening 133. The air-guide piece 132 is disposed inside the accommodating space 111 and is connected to the blower 131. An end of the air-guide piece 132 is exposed from the housing 11. Furthermore, after the blower 131 is started, the air 20 inside the accommodating space 111 is extracted, to change the air pressure inside the accommodating space 111, and the air 20 outside the housing 11 is drawn in through the plurality of narrow air inlets 112. Moreover, the air 20 flows through the blower inlet opening 133 to the blower 131, and the air 20 is processed to generate a drying air flow 30 and the drying air flow 30 is conveyed to the air-guide piece 132. The air-guide piece 132 receives the drying air flow 30, and pushes the drying air flow 30 outside the hand dryer 10.

Moreover, referring to FIG. 1 and FIG. 2 again, the switching sensing element 14 may be an infrared sensor, or another sensing element that can determine whether an object approaches. The switching sensing element 14 is disposed inside the accommodating space 111 and is electrically connected to the blower 131. Furthermore, the switching sensing element 14 is mounted at a position on the blower 131 and near the air-guide piece 132. Once it is determined that the hands of a user approach the air-guide piece 132, the switching sensing element 14 sends a switching signal to require the blower 131 to start, so that the blower 131 extracts the air 20 and generates the drying air flow 30. The drying air flow 30 is then blown out to the hands of the user through the air-guide piece 132 to dry the hands.

Next, referring to FIG. 4, FIG. 5 and FIG. 6 in conjunction, the hand dryer 10 of the present invention has an air intake path. The air intake path is generated after the air supply module 13 is started. Specifically, when the blower 131 receives the switching signal and is started, the blower 131 begins to work and generates a suction force, to enable the air 20 outside the housing 11 to continuously flow through the plurality of narrow air inlets 112 and the plurality of narrow air guide holes 122, and the air 20 eventually reach the blower 131. A specific path of the air intake path is the path of the air 20. Accordingly, in the present invention, the plurality of narrow air inlets 112 and the plurality of narrow air guide holes 122 form the double-slit structure, so that each partial sound wave generated when the air 20 flows through one of the plurality of narrow air inlet 112 is canceled by a sound wave generated at another adjacent narrow air inlet 112, so as to form a sound wave with relatively low noise. After passing through one of the plurality of narrow air guide holes 122, the sound wave with relatively low noise is interfered with and is canceled again by a sound wave with relatively low noise that passes through another adjacent narrow air guide hole 122, so as to form a sound wave with the lowest noise. In this way, a noise reduction effect is achieved.

What is claimed is:

1. A hand dryer with reduced air-intake noise, comprising:

a housing, including an accommodating space and a plurality of narrow air inlets connecting the accommodating space and an outside of the housing, and the housing defines an air intake surface that faces the accommodating space and on which the plurality of narrow air inlets are provided;

a flow-guide plate disposed inside the accommodating space and assembled, corresponding to the air intake surface with the housing, the flow-guide plate being not in contact with the air intake surface, and the flow-guide plate including a plurality of narrow air guide holes; and an air supply module disposed inside the accommodating space, comprising a blower that extracts the air inside the accommodating space to generate a drying air flow after being started and an air-guide piece that is connected to the blower to receive the drying air flow and includes an end exposed from the housing; and wherein the hand dryer includes an air intake path that enables, after the blower is started, the air sequentially flows from the outside of the housing to enter the blower through the plurality of narrow air inlets and the plurality of narrow air guide holes.

2. The hand dryer with reduced air-intake noise of claim 1, wherein the flow-guide plate includes a plate body on which the plurality of narrow air guide holes are provided and an extension sheet that extends from the plate body and is mounted at the housing.

3. The hand dryer with reduced air-intake noise of claim 2, wherein the flow-guide plate includes at least one support post that is disposed on a side facing the air intake surface and protrudes towards the housing to be connected to the housing.

4. The hand dryer with reduced air-intake noise of claim 1, wherein the plurality of narrow air inlets are arranged in a first matrix and provided on the housing, and the plurality of narrow air guide holes are arranged in a second matrix and provided on the flow-guide plate.

5. The hand dryer with reduced air-intake noise of claim 4, wherein the plurality of narrow air inlets are provided on the housing in a first extending direction, the plurality of narrow air guide holes are provided on the flow-guide plate in a second extending direction, and projection locations of the plurality of narrow air inlets are not overlapped with the plurality of narrow air guide holes.

* * * * *